US006939191B1

(12) United States Patent
Wu

(10) Patent No.: US 6,939,191 B1
(45) Date of Patent: Sep. 6, 2005

(54) CORD GUIDED FRISBEE

(76) Inventor: Pao-Chang Wu, 58, Ma Yuan West St., Taichung (TW)

( * ) Notice: Subject to any disclaimer, the term of this patent is extended or adjusted under 35 U.S.C. 154(b) by 10 days.

(21) Appl. No.: 10/826,934

(22) Filed: Apr. 16, 2004

(51) Int. Cl.[7] ..... A63H 27/00
(52) U.S. Cl. ..... 446/46
(58) Field of Search ..... 446/46, 47, 48; 473/588, 589, 590

(56) References Cited

U.S. PATENT DOCUMENTS 4,253,672 A * 3/1981 Milzoff et al. ..... 473/588
5,358,440 A * 10/1994 Zheng ..... 446/48
6,113,453 A * 9/2000 Stuffelbeam ..... 446/46
6,174,214 B1 * 1/2001 Cooper ..... 446/46

* cited by examiner

*Primary Examiner*—Derris H. Banks
*Assistant Examiner*—Faye Francis
(74) *Attorney, Agent, or Firm*—Alan D. Kamrath; Nikolai & Mersereau, P.A.

(57) ABSTRACT

A frisbee includes an annular main disk, and an annular support member mounted on the main disk. Thus, the support member can be detached from the main disk, so that the frisbee is foldable when not in use, thereby facilitating storage, package and transportation of the frisbee. In addition, the frisbee is guided by the cord to fly along a circumferential orbit, so that the frisbee can be played by a single player. Further, the frisbee can be played by two players and can also be played by a single player, thereby enhancing the versatility of the frisbee.

16 Claims, 4 Drawing Sheets

CORD GUIDED FRISBEE

BACKGROUND OF THE INVENTION

1. Field of the Invention

The present invention relates to a cord guided frisbee, and more particularly to a frisbee, wherein the support member can be detached from the main disk to be folded respectively, so that the frisbee is foldable when not in use, thereby facilitating storage, package and transportation of the frisbee.

2. Description of the Related Art

A conventional frisbee is made of a circular plastic disk that can be thrown upward and can be played by more than two players, thereby achieving the playing and amusing effect. However, the conventional frisbee has to be played by more than two players and cannot be played by a single person, thereby limiting the versatility of the conventional frisbee. In addition, the conventional frisbee has a fixed structure and cannot be folded when not in use, thereby causing inconvenience in storage, package and transportation of the frisbee.

SUMMARY OF THE INVENTION

The primary objective of the present invention is to provide a frisbee, wherein the support member can be detached from the main disk to be folded respectively, so that the frisbee is foldable when not in use, thereby facilitating storage, package and transportation of the frisbee.

Another objective of the present invention is to provide a frisbee, wherein the frisbee is guided by the cord held by the handle to fly along a determined circumferential orbit, so that the frisbee can be played by a single player.

A further objective of the present invention is to provide a frisbee, wherein the frisbee can be played by two players as usual and can also be played by a single player, thereby enhancing the versatility of the frisbee.

A further objective of the present invention is to provide a frisbee, wherein the support member is mounted on the outer peripheral wall of the main disk to provide a close tension to the main disk, so that the main disk is stretched and expanded rigidly and stably.

In accordance with the present invention, there is provided a frisbee, comprising an annular main disk, and an annular support member mounted on the main disk, wherein:

- the main disk has an inner peripheral wall and an outer peripheral wall each provided with a stitch line having two distal ends and formed with an opening located between the two distal ends;
- each of the inner peripheral wall and the outer peripheral wall of the main disk is provided with a clamping line extended through the stitch line and having two distal ends combined with each other and each protruding outward from the opening of the stitch line; and
- the support member is mounted on the outer peripheral wall of the main disk.

Further benefits and advantages of the present invention will become apparent after a careful reading of the detailed description with appropriate reference to the accompanying drawings.

DETAILED DESCRIPTION OF THE INVENTION

Figure 1:
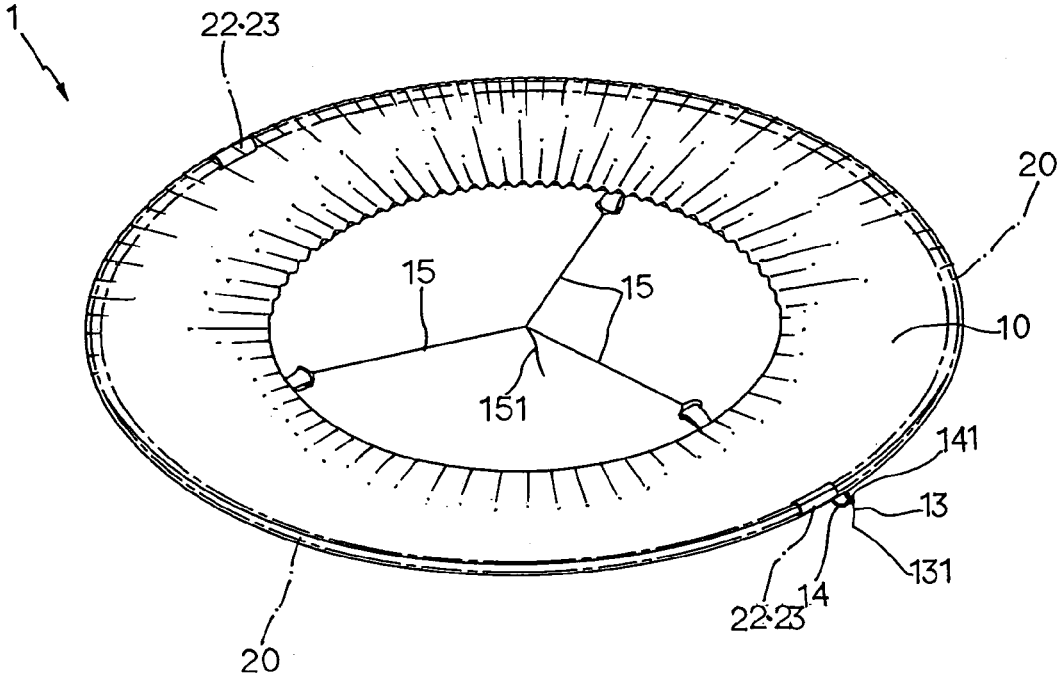
FIG. 1 is a perspective view of a frisbee in accordance with the preferred embodiment of the present invention.
Figure 2:
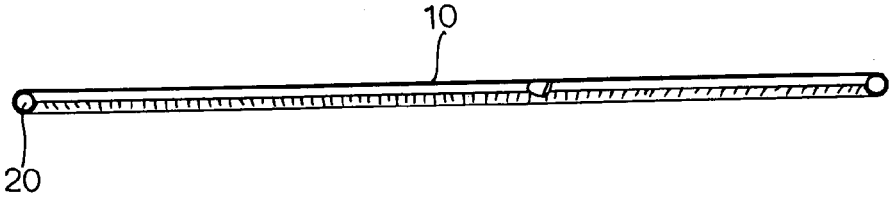
FIG. 2 is a plan view of the frisbee as shown in FIG. 1.
Figure 3:
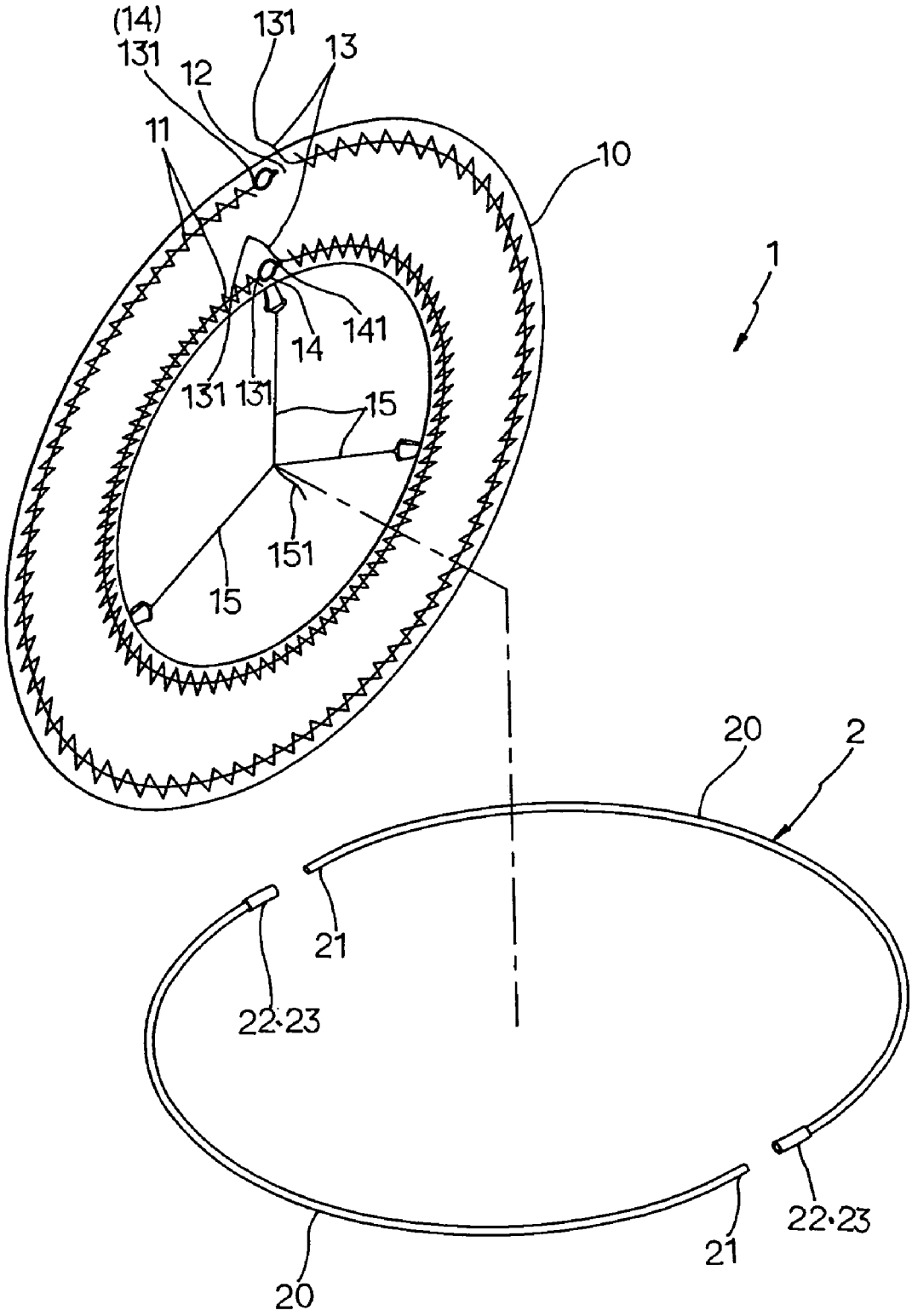
FIG. 3 is an exploded perspective view of the frisbee as shown in FIG. 1.

Referring to the drawings and initially to FIGS. 1–3, a frisbee 1 in accordance with the preferred embodiment of the present invention comprises an annular main disk 10, and an annular support member 2 mounted on the main disk 10.

The main disk 10 is made of flexible cloth. The main disk 10 has an inner peripheral wall and an outer peripheral wall each provided with a serrated stitch line 11 having two distal ends and formed with an opening 12 located between the two distal ends. Each of the inner peripheral wall and the outer peripheral wall of the main disk 10 is provided with a retractable clamping line 13 retractably mounted in and extended through the stitch line 11 and having two distal ends 131 each protruding outward from the opening 12 of the stitch line 11. One of the two distal ends 131 of the clamping line 13 of each of the inner peripheral wall and the outer peripheral wall of the main disk 10 is provided with an urging ring 14 formed with a locking groove 141. The inner peripheral wall of the main disk 10 has a rim provided with a plurality of equally spaced connecting lines 15 extended toward a center of the main disk 10 and combined with each other to form a protruding connecting section 151.

The support member 2 is mounted on the outer peripheral wall of the main disk 10 and includes two support rods 20 combined with each other. Each of the two support rods 20 of the support member 2 is bent to form a semi-circular shape. Each of the two support rods 20 of the support member 2 has a first end 21 and a second end 22 and has a connecting tube 23 mounted on the second end 22. Thus, the connecting tube 23 of the second end 22 of one of the two support rods 20 is mounted on the first end 21 of the other one of the two support rods 20, so that the two support rods 20 are combined with each other to form the support member 2.

In assembly, the clamping line 13 of the outer peripheral wall of the main disk 10 is stretched outward to drive the outer peripheral wall of the main disk 10 to contract radially inward to clamp the support member 2 on the outer peripheral wall of the main disk 10. Then, one distal end 131 of the clamping line 13 of the outer peripheral wall of the main disk 10 is extended through the urging ring 14 on the other distal end 131 of the clamping line 13 of the outer peripheral wall of the main disk 10 and is locked in the locking groove 141 of the urging ring 14, so that the clamping line 13 of the outer peripheral wall of the main disk 10 is tightened. Then, one distal end 131 of the clamping line 13 of the inner peripheral wall of the main disk 10 is extended through the urging ring 14 on the other distal end 131 of the clamping line 13 of the inner peripheral wall of the main disk 10 and is locked in the locking groove 141 of the urging ring 14, so that the clamping line 13 of the inner peripheral wall of the main disk 10 is tightened. In such a manner, the surface of the main disk 10 forms a close tension by tightening the clamping line 13 of the main disk 10, so that the support member 2 is mounted on the main disk 10 rigidly and stably to form the frisbee 1.

Figure 4:
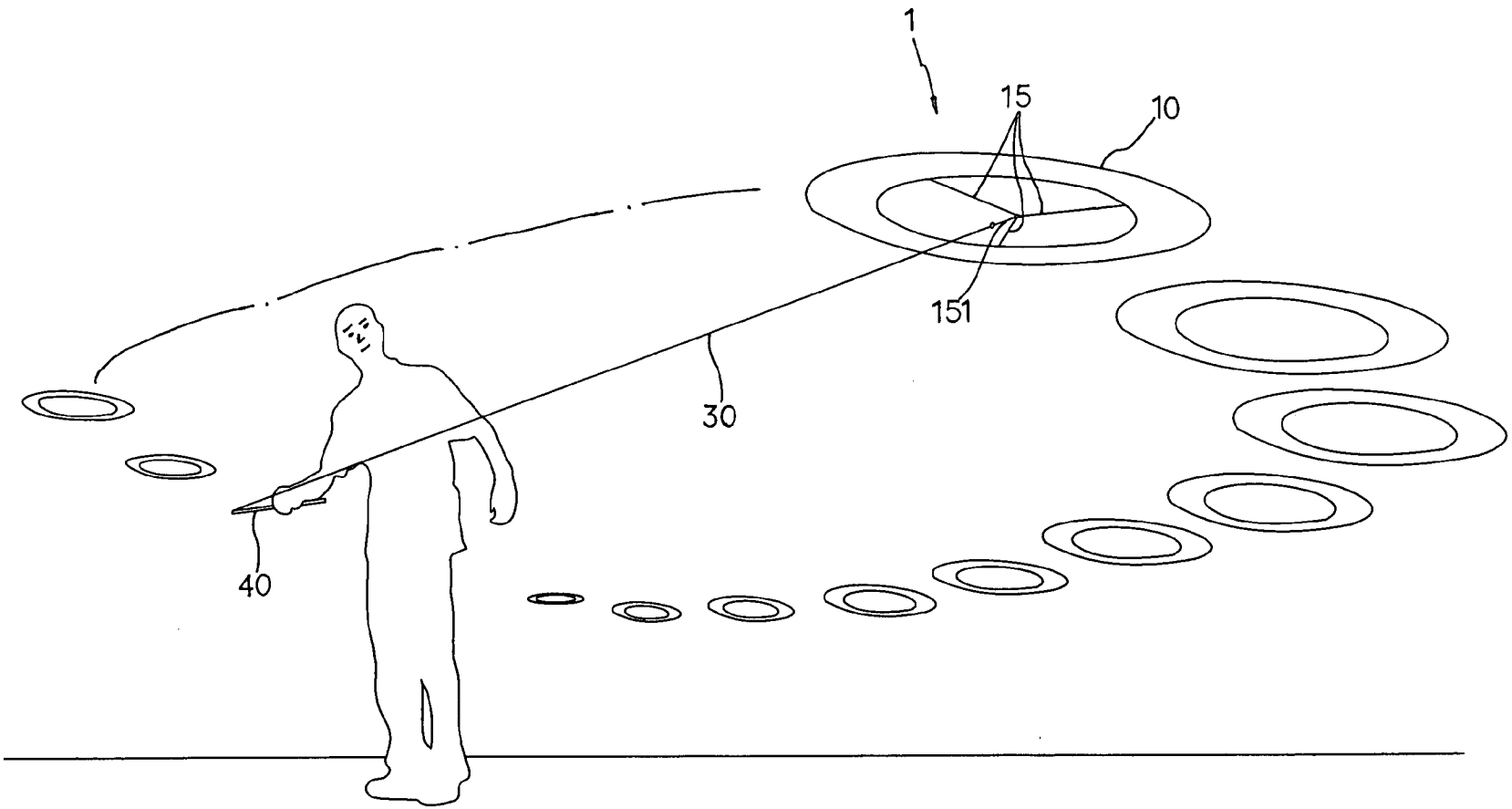
FIG. 4 is a schematic operational view of the frisbee as shown in FIG. 1 in use.

As shown in FIG. 4, the frisbee 1 further comprises a cord 30 having a first end connected to the connecting section 151 of the connecting lines 15 of the main disk 10 and a second end provided with a handle 40. In such a manner, a user can hold the handle 40 to draw the frisbee 1 to fly along a determined circumferential orbit by guidance of the cord 30.

Figure 5:
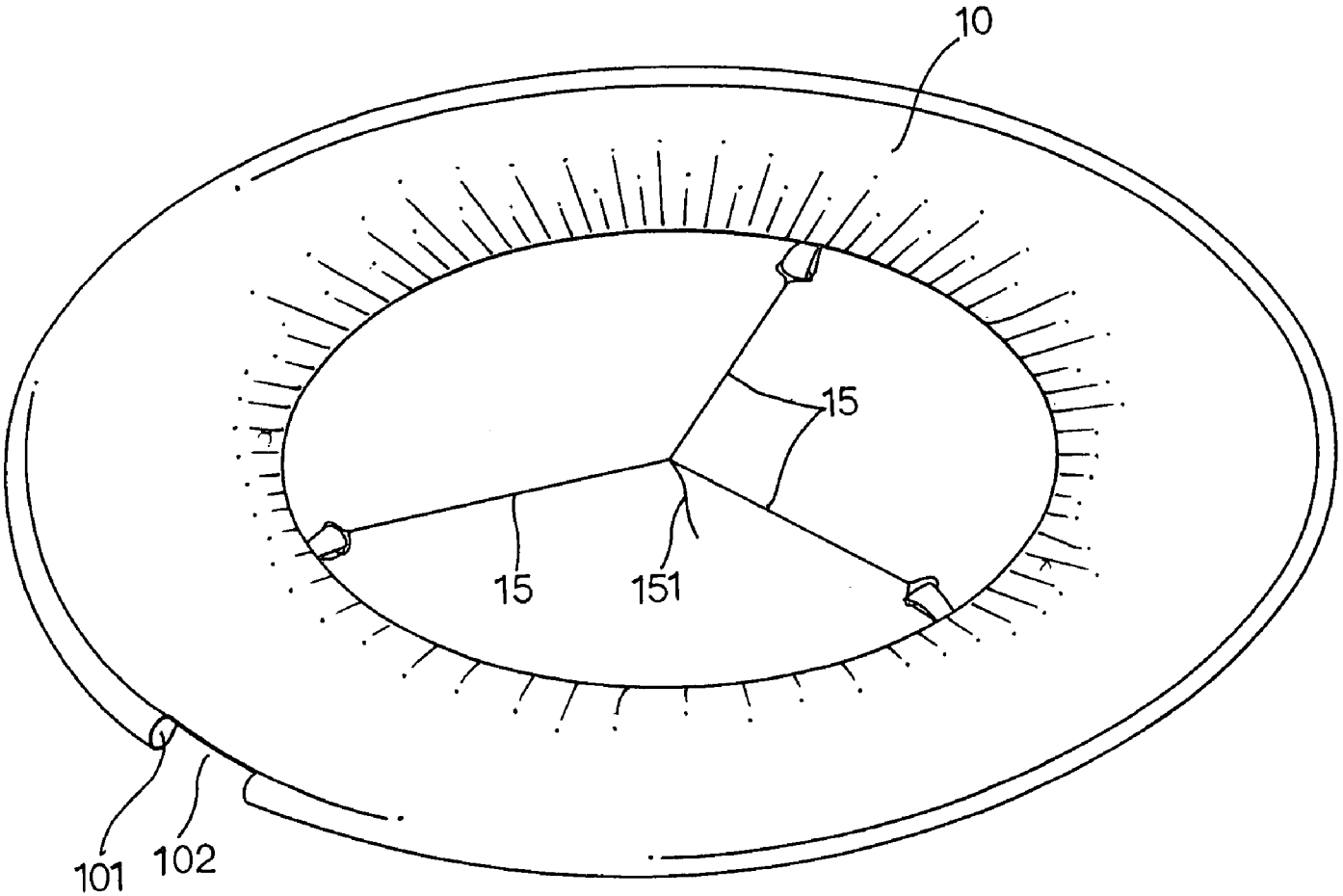
FIG. 5 is a perspective view of a frisbee in accordance with another embodiment of the present invention.

As shown in FIG. 5, the outer peripheral wall of the main disk 10 is formed with a receiving space 101 for receiving the support member 2. In addition, the outer peripheral wall of the main disk 10 has two distal ends and is formed with an opening 102 located between the two distal ends and communicating with the receiving space 101 to expose the receiving space 101.

Accordingly, the support member 2 can be detached from the main disk 10 to be folded respectively, so that the frisbee 1 is foldable when not in use, thereby facilitating storage, package and transportation of the frisbee 1. In addition, the frisbee 1 is guided by the cord 30 held by the handle 40 to fly along a determined circumferential orbit, so that the frisbee 1 can be played by a single player. Further, the frisbee 1 can be played by two players as usual and can also be played by a single player, thereby enhancing the versatility of the frisbee 1. Further, the support member 2 is mounted on the outer peripheral wall of the main disk 10 to provide a close tension to the main disk 10, so that the main disk 10 is stretched and expanded rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A frisbee, comprising an annular main disk, and an annular support member mounted on the main disk, wherein:

the main disk has an inner peripheral wall and an outer peripheral wall each provided with a stitch line having two distal ends and formed with an opening located between the two distal ends;

each of the inner peripheral wall and the outer peripheral wall of the main disk is provided with a clamping line extended through the stitch line and having two distal ends combined with each other and each protruding outward from the opening of the stitch line; and the support member is mounted on the outer peripheral wall of the main disk.

2. The frisbee in accordance with claim 1, wherein the main disk is made of flexible cloth.

3. The frisbee in accordance with claim 1, wherein the stitch line has a serrated shape.

4. The frisbee in accordance with claim 1, wherein the clamping line is retractable and retractably mounted in and extended through the stitch line.

5. The frisbee in accordance with claim 1, wherein the clamping line of the outer peripheral wall of the main disk is stretched outward to drive the outer peripheral wall of the main disk to contract radially inward to clamp the support member on the outer peripheral wall of the main disk.

6. The frisbee in accordance with claim 1, wherein the one of the two distal ends of the clamping line of the outer peripheral wall of the main disk is provided with an urging ring formed with a locking groove, and the other one of the two distal ends of the clamping line of the outer peripheral wall of the main disk is extended through the urging ring and is locked in the locking groove of the urging ring, so that the clamping line of the outer peripheral wall of the main disk is tightened.

7. The frisbee in accordance with claim 1, wherein the one of the two distal ends of the clamping line of the inner peripheral wall of the main disk is provided with an urging ring formed with a locking groove, and the other one of the two distal ends of the clamping line of the inner peripheral wall of the main disk is extended through the urging ring and is locked in the locking groove of the urging ring, so that the clamping line of the inner peripheral wall of the main disk is tightened.

8. The frisbee in accordance with claim 1, wherein the inner peripheral wall of the main disk has a rim provided with a plurality of equally spaced connecting lines extended toward a center of the main disk and combined with each other to form a protruding connecting section.

9. The frisbee in accordance with claim 8, further comprising a cord having a first end connected to the connecting section of the connecting lines of the main disk and a second end provided with a handle.

10. The frisbee in accordance with claim 1, wherein the support member includes two support rods combined with each other.

11. The frisbee in accordance with claim 10, wherein each of the two support rods of the support member is bent to form a semi-circular shape.

12. The frisbee in accordance with claim 10, wherein each of the two support rods of the support member has a first end and a second end and has a connecting tube mounted on the second end.

13. The frisbee in accordance with claim 12, wherein the connecting tube of the second end of one of the two support rods is mounted on the first end of the other one of the two support rods, so that the two support rods are combined with each other to form the support member.

14. The frisbee in accordance with claim 1, wherein the outer peripheral wall of the main disk is formed with a receiving space for receiving the support member.

15. The frisbee in accordance with claim 14, wherein the outer peripheral wall of the main disk has two distal ends and is formed with an opening located between the two distal ends and communicating with the receiving space to expose the receiving space.

16. The frisbee in accordance with claim 14, wherein the support member is detachable from the main disk to be folded respectively, so that the frisbee is foldable.

* * * * *